United States Patent [19]

Lewis et al.

[11] Patent Number: 4,568,076

[45] Date of Patent: Feb. 4, 1986

[54] DESTACKING DEVICE

[75] Inventors: D. Michael Lewis; David L. Wolf, both of Cedar Falls, Iowa

[73] Assignee: Container Corporation of America, Chicago, Ill.

[21] Appl. No.: 640,825

[22] Filed: Aug. 15, 1984

[51] Int. Cl.[4] ..... B65H 3/24; B65H 3/46

[52] U.S. Cl. ..... 271/128; 198/747; 414/119

[58] Field of Search ..... 414/114, 117, 119; 271/42, 128, 130; 221/232, 244; 198/747, 748

[56] References Cited

U.S. PATENT DOCUMENTS

| | | | |
|---|---|---|---|
| 1,174,739 | 3/1916 | Langston | 271/128 |
| 1,235,562 | 8/1917 | Freeman | 271/130 |
| 2,621,806 | 12/1952 | Van Schie | 221/253 X |
| 3,279,791 | 10/1966 | Fisher | 271/42 |
| 3,357,700 | 12/1967 | Bradicich | 271/130 |
| 3,456,779 | 7/1969 | Andreae | 198/748 |
| 3,844,426 | 10/1974 | Campbell | 414/119 X |
| 4,229,134 | 10/1980 | Reist | 198/747 X |

*Primary Examiner*—Leslie J. Paperner

*Attorney, Agent, or Firm*—Richard W. Carpenter

[57] ABSTRACT

A device for automatically feeding, one at a time, relatively thin, flat articles, such as paperboard sheets or knocked down boxes, from the top of the stack of articles positioned on an elevating mechanism.

1 Claim, 5 Drawing Figures

DESTACKING DEVICE

BACKGROUND OF THE INVENTION

1. Field of the Invention

This invention relates generally to destacking devices, and more particularly to a device for automatically feeding, one at a time, relatively thin flat articles, such as paperboard sheets or knocked down boxes from the top of a stack of such articles.

2. Description of the Prior Art

A prior art search directed to the subject matter of this application in the United States Patent and Trademark Office disclosed the following U.S. Pat. Nos. 1,033,951; 1,795,436; 2,593,814; 2,601,072; 2,621,806; 2,679,799; 2,826,336; 3,165,312; 4,395,032.

None of the prior art patents uncovered in the search discloses a destacking mechanism or device like that of the present invention which includes a floating gate mechanism having a portion resting on the topmost article of the stack of articles to be dispensed, so that only one article at a time will be fed through the gate mechanism, and wherein the gate mechanism is mounted in such a manner as to be able to move slight distances laterally, vertically, and diagonally to accommodate receipt of articles which are not in a perfectly level position.

SUMMARY OF THE INVENTION

It is an object of the present invention to provide a a device for automatically feeding, one at a time, relatively thin, flat articles, such as paperboard sheets or knocked down boxes, from the top of a stack of articles positioned on an elevating mechanism and delivering them to another station in a packaging forming and filling line.

A more specific object of the invention is the provision of unique gating arrangement which permits only one article at a time to be dispensed from the top of a stack of flat articles.

Another specific object of the invention is the provision of a unique mounting for a gating mechanism which will permit the gate to move slightly vertically, laterally, or diagonally, to accommodate articles which are not in a perfectly level position.

These and other objects of the invention will be apparent from an examination of the following description and drawings.

It will be understood that, for purposes of clarity, certain elements may have been intentionally omitted from certain views, where they are believed to be illustrated to better advantage in other views.

DESCRIPTION OF THE PREFERRED EMBODIMENT

Figure 1:
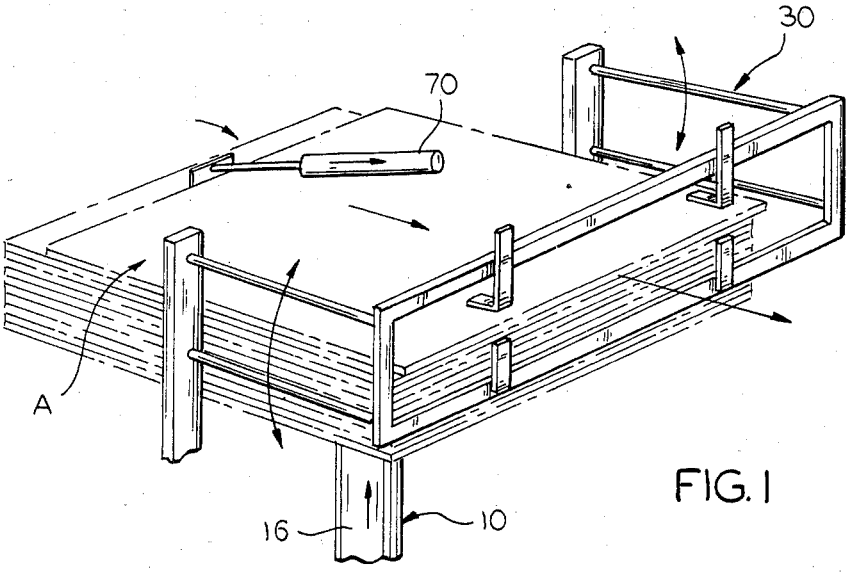
FIG. 1 is a schematic perspective view of a stacking device embodying features of the invention.

Referring now to the drawings for a better understanding of the invention, and particularly to FIG. 1, it will be seen that the device is a destacking mechanism adapted to take one relatively thin flat article, such as sheet of paperboard or knocked down box indicated generally at A, from the top of a stack of articles positioned on an elevating mechanism, not shown, and deliver the article through a gate assembly to a pair of feed rollers which transfer the article onto another station in a package forming and filling line.

Figure 2:
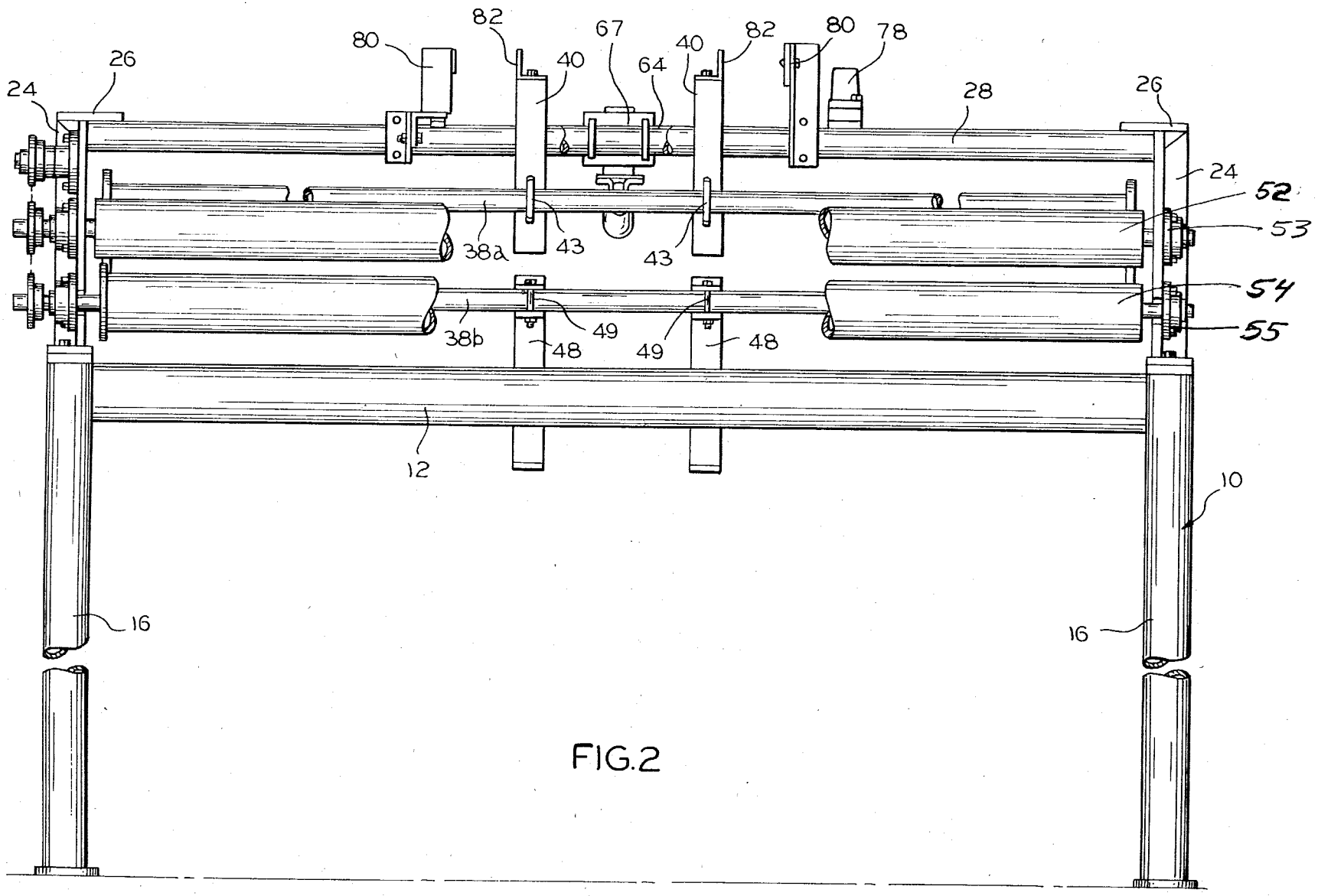
FIG. 2 is a fragmentary front elevational view of a destacking device embodying features of the invention.
Figure 3:
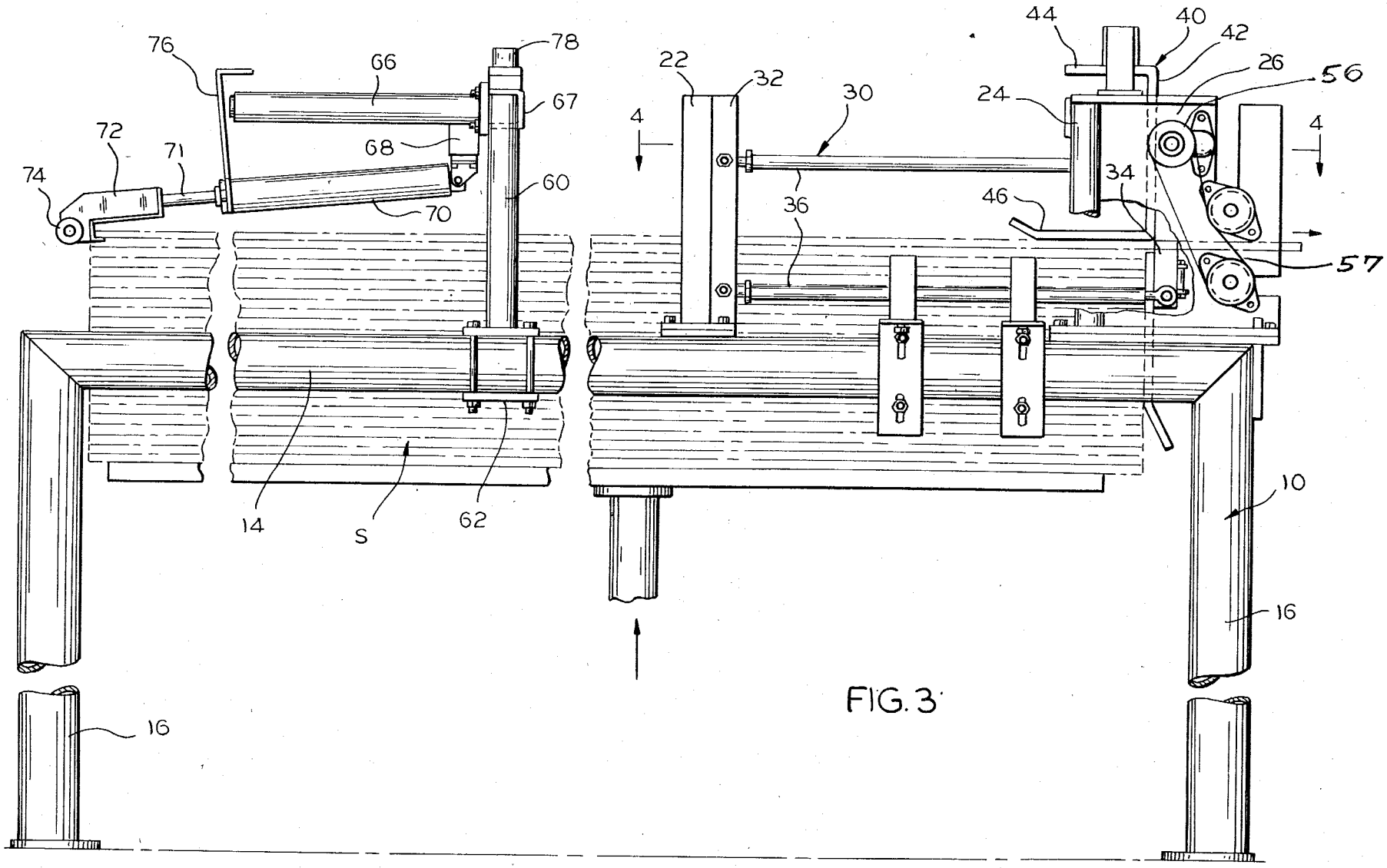
FIGS. 3 is a side elevational view of the structure illustrated in FIG. 1.

As best seen in FIGS. 2 and 3, the device includes a frame indicated generally at 10, having a gate assembly, indicated generally at 30, positioned thereon and a feed assembly, indicated generally at 50, also positioned adjacent the gate assembly to effect the transfer of articles to another station in a packaging line.

Still referring to FIGS. 2 and 3, it will be seen that frame has a base or lower section which includes a front end rail 12, and rear end rail (not shown) which are connected to each other by a parallel side rails 14, with the rails all being supported at corners of the frame by a plurality of legs 16.

It is contemplated that the frame would be positioned over a stack of articles which are positioned on an elevating mechanism. The details of the elevating mechanism are not shown because they do not form an essential part of this invention.

Figure 4:
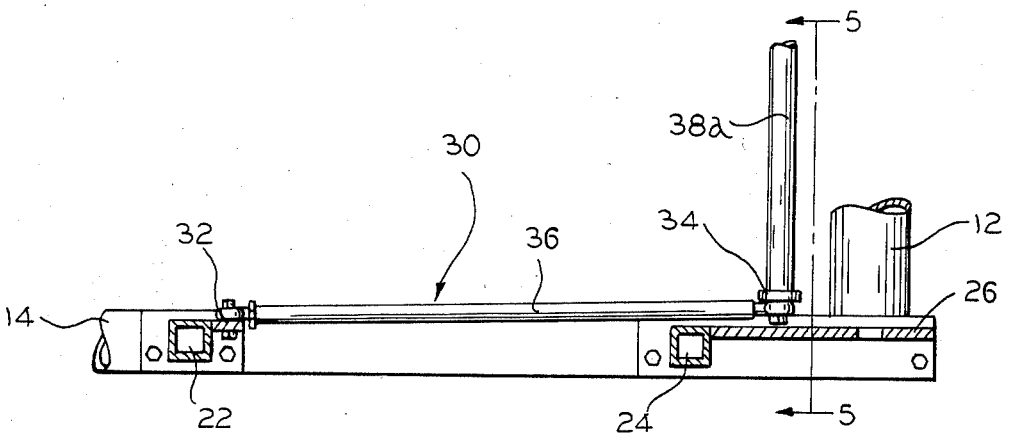
FIG. 4 is a fragmentary sectional view taken on line 4—4 of the FIG. 3.
Figure 5:
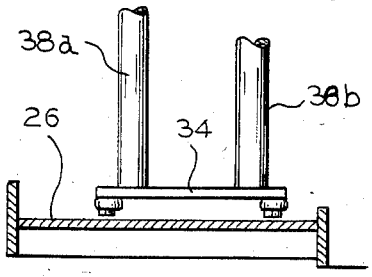
FIG. 5 is a fragmentary sectional view taken on line 5—5 of FIG. 4.

The upper section of frame 10, includes a pair of vertically upstanding rear posts 22, and a pair of front posts 24 all of which are secured to the front and side rails 12 and 14, respectively, of the lower frame section. At each side of the frame there is located a front mounting bracket 26, which is secured, preferably by welding, as best seen in FIG. 4, to the related front post 24. The upper portions of the front mounting brackets 26, are interconnected by a transversely extending horizontal front mounting bar 28, which is best seen in FIG. 2.

The portion of the device which makes the present invention most unique is the gate assembly, indicated generally at 30, which is mounted on the frame.

The gate assembly includes a pair of upstanding rear bars 32 which, as best seen in FIG. 4, are secured to rear posts 22 in any manner, such as by welding, so they become in essence a fixed part of the overall frame. The gate assembly also includes a pair of movable front bars 34 which are positioned over the front portion of the frame and which are secured movably to the respective rear bars 32 by pairs of parallel tie rods 36 which extend transversely between the front and rear bars to provide a parallelogram type mounting arrangement. The upper and lower portions of the front bars 34 are connected to each other by a pair of upper and lower transverse tubes **38*a* and 38*b*** respectively.

The pivotal connections between tie rods 36 and front and rear bars 34 and 32 are provided with sufficient slackness to permit the front bars to not only move vertically with respect to the rear bars, but also to move laterally a slight distance and diagonally in either direction a slight amount. The purpose for this flexibility will be described later in the application.

The gate assembly 30 also includes a pair of upper gate members indicated generally at 40. As best seen in FIGS. 2 and 3 each of the upper gate members 40 is generally U-shaped having a generally vertical section 42 with a pair of integral upper and lower sections 44 and 46 extending rearwardly from upper and lower ends thereof. Vertical sections 42 are attached to the upper transverse tube 38*a* by means of U-clamps 43. Each lower horizontal section or shoe 46 which extends rearwardly from the vertical section 42 is adapted to ride on the uppermost article of the articles piled on the stack.

Additionally, there are provided a pair of lower gate members 48 which are attached to the lower transverse tubes 38*b* by means of U-clamps 49. The distance between the upper and lower gate members may be adjusted to provide a space which is just slightly larger than the articles which are to be received through the gate opening. The purpose of this is to insure that, as the articles are fed from the stack, only one article at a time will pass through the gate opening.

As previously mentioned, the connection between the tie rods 36 and the rear bars 32 and front bars 34 of the gate assembly are not rigid, but do afford enough flexibility to permit the front portion of the gate assembly to flex and move laterally and diagonally with respect to the fixed rear bars 32 to accommodate articles that are not stacked even or in a level position on the pile of articles. The uppermost article of the stack of articles is pulled through the gate assembly by a rake-type mechanism which is described later in the application. As the article moves through the gate assembly it is taken away from the destacking device by means of a feed assembly which includes a pair of upper and lower transversely extending feed rollers 52 and 54, respectively, the ends of which are mounted in the front mounting brackets 26. Upper driven roller 52 has at its end pulleys 53, and lower driven roller 54 has at its end a pulleys 56, all of which are connected by a chain 57 to a slack take-up pulley 56 mounted on the front mounting bracket 26 above the upper roller.

Upper roller 52 and lower roller 54 may be driven in a conventional manner by a motor and drive train mounted on the frame but not shown in detail as it does not form an essential part of this invention. The rollers are turning at all times when the machine is turned on.

The feed roller assembly constitutes the front portion of the feed assembly, and mounted at the rear portion of the frame is a rake assembly which serves to transfer the uppermost article on the stack of articles forwardly through the gate assembly.

The rake assembly includes a pair of vertically extending side posts 60 which extend upwardly from and are mounted to respective frame side rails 14 by a pair of plate clamps 62. Upper portions of side post 60 are interconnected by transverse bar 64 which forms a bridge bearing the remaining portion of the rake assembly. A longitudinally extending bar or rear bracket stop 66 is attached to the transverse bar 64 by means of another clamp 67. Secured to and extending downwardly from rear bracket stop 66 is a cylinder mount 68. Pivotally connected to the cylinder mount 68 is a rearwardly extending air cylinder 70 having piston 71 with a rake 72 attached to the rearward extremity thereof. The rake, as best seen in FIG. 3, has at least one wheel 74 mounted thereon so the rake will ride on the second-most article as it moves rearwardly and forwardly. Extending upwardly from the rearward part of the cylinder is a bracket 76 which is adapted to engage the rearward extremity of rear bracket 66 to prevent cylinder from falling when a new stack of articles is being loaded onto the elevating mechanism.

The rake cylinder piston is actuated by a solenoid valve 78 mounted atop the transverse bar 64.

In describing the operation of the device, the elevating mechanism, not shown, is adapted to continually exert pressure so as to move the article upwardly until the upward motion is temporarily stopped by a control mechanism mounted on the frame mounting bar 28, as best seen FIG. 2. Mounted on bar 28 is a photoelectric cell arrangement 80 the beam of which can be interrupted by a pair of upper gate extensions 82 mounted on the upper extremities of upper gate members 40. Thus, if the pile or stack of articles gets too high the upper gate members which ride on the upper article are moved upwardly a sufficient distance to have the upper gate extension 82 interrupt the beam of the photoelectric cell and temporarily shut off the elevating mechanism.

As previously mentioned, as the elevating mechanism and the photoelectric cell arrangement for stopping and starting its operation are not directly related to the novel portion of this invention, their details are not illustrated.

Thus, it will be appreciated that the present invention provides a novel gating arrangement to allow the automatic feeding, one at a time, of relatively thin articles from the top of a stack of such articles even though the uppermost article is not level or in perfect alignment with the other articles or with the gating mechanism.

What is claimed is:

1. In a device for automatically feeding, one at a time, relatively thin articles, such as paperboard sheets or knocked down boxes, from the top of a stack of such articles positioned on an elevating mechanism, the combination of:

(a) a frame positionable over a stack of articles;

(b) a gate assembly mounted on said frame, including:

(i) a pair of vertically disposed laterally aligned rear fixed bars secured to and extending upwardly from opposite sides of said frame intermediate the front and rear ends thereof;

(ii) a pair of vertically disposed, floating front bars aligned with respective rear bars and positioned adjacent the front end of said frame;

(iii) pairs of generally horizontally disposed tie rods pivotally interconnecting related front and rear bars to provide parallelogram linkage therebetween;

(iv) a pair of generally horizontally disposed, parallel upper and lower transverse tubes interconnecting upper and lower ends, respectively, of said front bars;

(v) at least one upper gate member connected to said upper transverse tube and having a rearwardly extending lower portion adapted to ride on the uppermost article of said stack;

(vi) at least one lower gate member connected to said lower transverse tube and spaced below said upper gate member a distance only slightly greater than the thickness of one of said articles to define therewith a gate opening for receiving the uppermost article on said stack;

(c) a feed assembly carried by said frame, comprising:

(i) a bridge carried by and extending transversely of said frame over said articles and positioned rearwardly of said gate assembly;

(ii) a valve and piston carried by said bridge;

(iii) a rake mechanism attached to said piston and including:

(A) a rake for engaging a rear edge of the uppermost article on said stack and moving it forwardly into said gate assembly;

(B) a roller positioned rearwardly of said rake and adapted to ride on an article located immediately below said uppermost article;

(iv) means for preventing said valve and piston from dropping too far when a new stack of articles is being transferred to said elevating mechanism, including:

(A) a stop element carried by said bridge over said valve and piston;

(B) a bracket attached to said valve and being engageable with said stop element when said valve is lowered to a predetermined level below said stop element.

* * * * *